US007121049B2

(12) United States Patent
Cohen et al.

(10) Patent No.: US 7,121,049 B2
(45) Date of Patent: Oct. 17, 2006

(54) STAKE-PULLING DEVICE

(76) Inventors: Jack H. Cohen, 9995 Dover Cyn Rd., Templeton, CA (US) 93465; Bob C. Brooks, 3820 N. River Rd., Paso Robles, CA (US) 93446

( * ) Notice: Subject to any disclaimer, the term of this patent is extended or adjusted under 35 U.S.C. 154(b) by 64 days.

(21) Appl. No.: 10/771,822

(22) Filed: Feb. 3, 2004

(65) Prior Publication Data

US 2005/0166486 A1 Aug. 4, 2005

(51) Int. Cl.
*E04H 12/20* (2006.01)
*E04H 17/22* (2006.01)

(52) U.S. Cl. ..... 52/156; 52/155; 7/167; 7/169; 7/170; 254/30; 254/131

(58) Field of Classification Search ..... 52/155, 52/156; 7/167, 169, 170; 254/199, 131, 254/243, 18, 29 R, 30; 248/156
See application file for complete search history.

(56) References Cited

U.S. PATENT DOCUMENTS 1,761,675 A * 6/1930 Mick ..... 254/132
2,994,510 A * 8/1961 Michalak ..... 254/30
3,163,398 A * 12/1964 Eckels ..... 254/29 R
3,773,292 A * 11/1973 Thiermann ..... 254/30
4,250,769 A * 2/1981 Herring ..... 74/525
4,726,565 A * 2/1988 Keller ..... 254/30
4,998,312 A * 3/1991 Donaldson ..... 7/166
5,052,659 A * 10/1991 Bates ..... 254/29 R
5,186,437 A * 2/1993 Scott ..... 254/30
5,224,687 A * 7/1993 Geckler et al. ..... 254/30
5,597,151 A * 1/1997 Duncan ..... 254/199
5,749,918 A * 5/1998 Hogendijk et al. ..... 623/1.14
5,833,215 A * 11/1998 Vandenburg ..... 254/30
5,988,595 A * 11/1999 DeVincent ..... 254/243
6,131,884 A * 10/2000 Broussard et al. ..... 254/30
6,641,347 B1 * 11/2003 Ewington ..... 414/23
6,866,248 B1 * 3/2005 Sears ..... 254/30
6,910,664 B1 * 6/2005 Bolinder et al. ..... 248/156

* cited by examiner

*Primary Examiner*—Jeanette Chapman
*Assistant Examiner*—Yvonne M. Horton

(57) ABSTRACT

A device that is used to pull a stake from a newly poured concrete slab. This device allows for attachment to a concrete pole, a tool that is commonly possessed and used by most concrete contractors. It contains a flexible loop that is used for the removal of stakes from the inside of a perimeter of a newly poured concrete slab. The loop of the device is placed so that it encircles the shaft of a concrete stake. A worker rotates the concrete pole until the loop twists enough to tightly hold onto the stake. The stake is then pulled from the ground and lifted up, over, and to the outside of the perimeter of the slab. The invention may include adjustment means to allow its efficient use with stakes of different thickness.

10 Claims, 2 Drawing Sheets

STAKE-PULLING DEVICE

BACKGROUND: FIELD OF THE INVENTION

This invention relates, in general, to tools used in construction and in particular to devices that attach to a concrete pole.

BACKGROUND: DESCRIPTION OF PRIOR ART

Often in creating by pouring and finishing a concrete slab, it is necessary to drive stakes somewhere in the interior of the perimeter of that slab. Often these stakes are used for holding guide boards that are used to screed the concrete to make a flat and level slab. After the wet and unset concrete has been screeded it is necessary to remove the boards that are used to guide this process. It is then necessary to remove the stakes. The stakes are removed by a worker walking through the wet concrete to pull out each stake. A worker then retamps and smooths the concrete as he retreats back out of the concrete. This proceedure often leaves unsatisfactory results leaving high spots and low spots on the finished slab. The process, besides leaving a less then perfect slab, takes considerable labor to complete all the steps required.

OBJECTS AND ADVANTAGES

Several objects and advantages of the present invention are:

(a) to provide a device that allows for the easy removal of stakes from a wet concrete slab, (b) to provide a tool that can be used with tools that are commonly in possession with a contractor in the business of constructing concrete slabs, (c) to provide a device that allows for the removal of a stake from a wet concrete slab without damaging the slab, (d) and to provide a device that is compact and easily carried.

Figure 1:
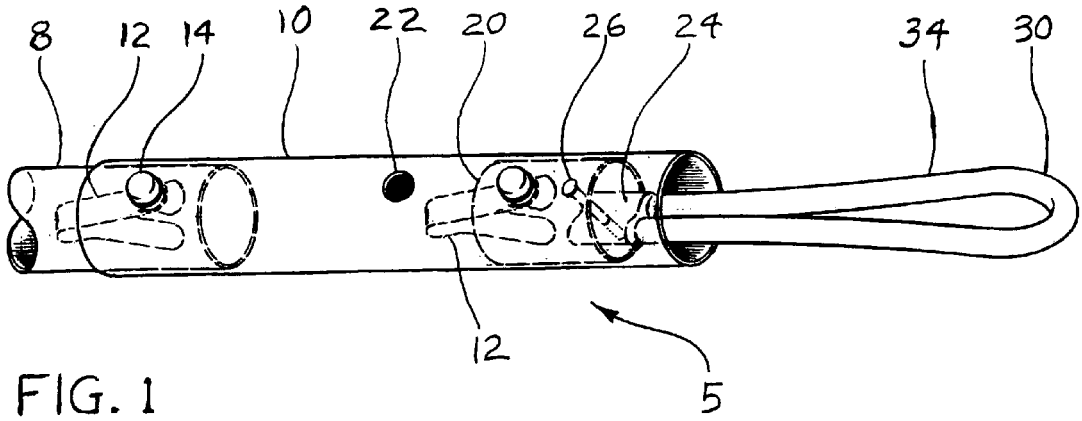
FIG. 1 is of a cross section transparent view of the invention attached to a concrete pole.
Figure 2:
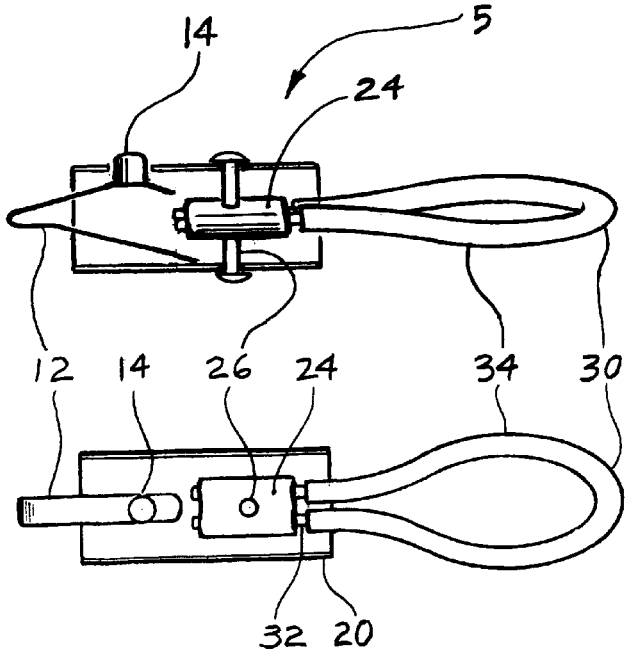
FIG. 2 is of two different view of a transparent view of the slider tube.
Figure 3:
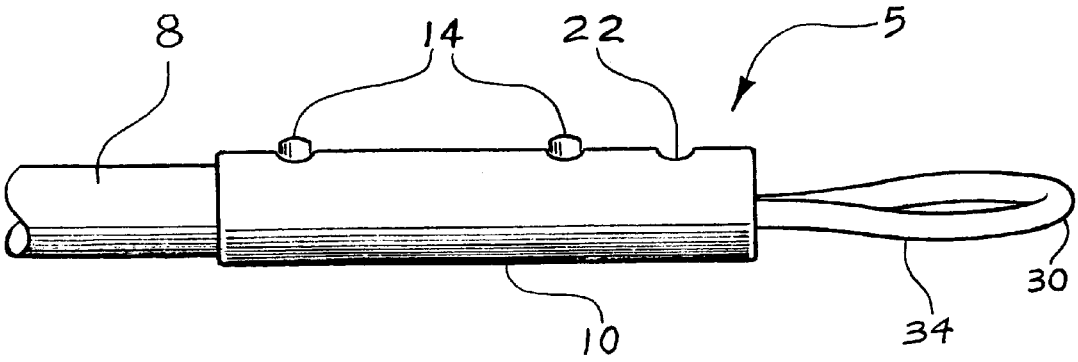
FIG. 3 is a drawing of the invention attached to a concrete pole.

| LIST OF REFERENCE NUMBERS | |
|---|---|
| Stake-pulling Device | 5 |
| Concrete pole | 8 |
| Sleeve tube | 10 |
| Spring button lock | 12 |
| Spring button | 14 |
| Slider tube | 20 |
| Hole | 22 |
| Ferrule | 24 |
| Securing pin | 26 |
| Loop | 30 |

-continued

| LIST OF REFERENCE NUMBERS | |
|---|---|
| Line | 32 |
| Flexible Tubing | 34 |

DESCRIPTION OF INVENTION

The invention is a stake-pulling device that is connected to one end of a concrete pole 8, also called a "snap-on handle". The invention comprises a larger rigid tube, or sleeve tube 10, that is slipped over one end of the concrete pole and is held in place by a spring button lock 12 that is positioned within the pole. A hole 22 in the concrete pole is aligned with a hole in the larger sleeve tube, and the button 14 of the button spring lock passes though both holes holding the sleeve tube securely in place on the concrete pole.

Within the sleeve tube is a smaller tube or slider 20, sized so that it can slide within the larger tube. Inside this slider is another spring button lock 12. A hole in the slider is aligned with one of the one or more holes in the larger tube. The button of the spring button lock passes though both holes holding the smaller tube in place within the larger tube.

Along with the spring button lock, an oval crimp sleeve or ferrule 24 is inside the circumference of the smaller tube. This ferrule is held in place by a securing pin 26 that passes through opposite sides of the smaller tube and through the ferrule. The ferrule is crimped over the opposite ends of a length of line 32 forming a loop 30. Over the line is a length of flexible tubing 34. The flexible tubing helps add structure to the loop and protects the line from abrasion. The loop protrudes from the end of the larger tube at the end opposite its attachment from the concrete pole.

In another embodiment of the invention the inside of the sleeve tube is threaded. The slider tube has corresponding female or male threads created so that the slider tube can be threaded into the sleeve tube. The slider tube has a loop attached to one end. The slider, when threaded into the sleeve tube causes the perimeter of the loop, that is outside the sleeve tube, to get smaller.

Figure 4:
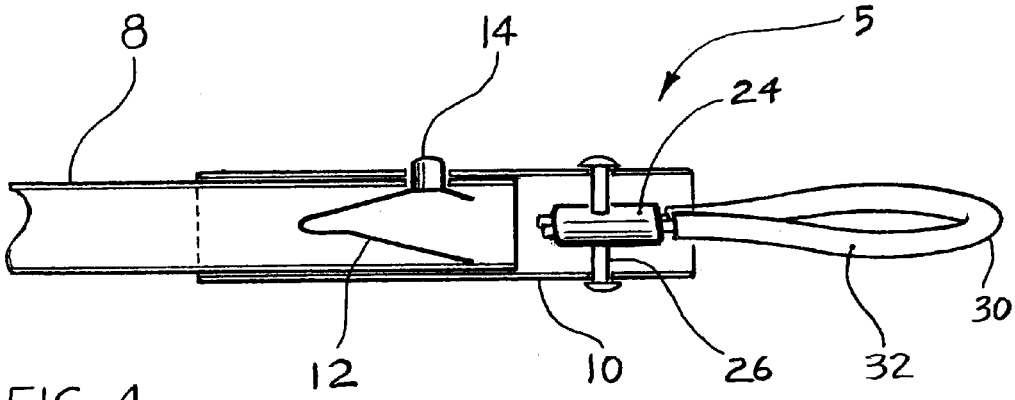
FIG. 4 is a transparent drawing of an embodiment of the invention with a fixed non-adjustable loop, without the slider tube.
Figure 5:
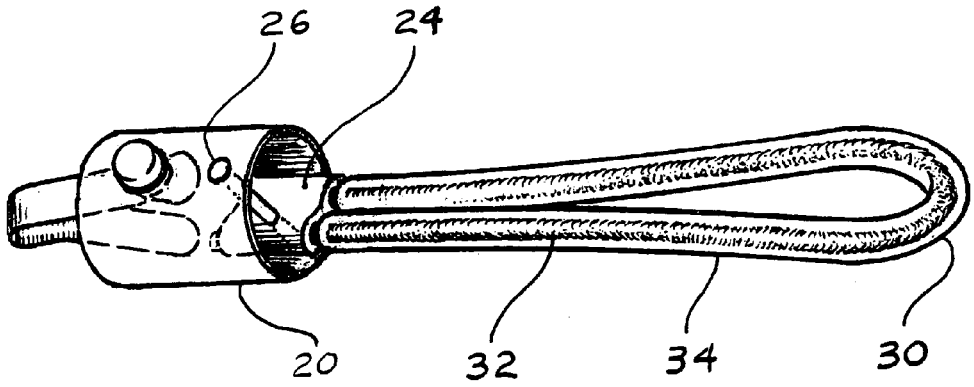
FIG. 5 is a top view drawing of the loop detail.

Another embodiment of the invention has the loop attached by a fixed attachment to the sleeve tube, and therefore is less adjustable then the above. An example (FIG. 4) of this has the ferrule held in place by the securing pin that passes through opposite sides of the sleeve tube. In this embodiment there is no slider tube.

OPERATION OF INVENTION

The stake-pulling device slides onto the end of a concrete pole. The hole in the concrete pole is aligned with the hole located near one end of the sleeve tube of the device. When aligned the button pops though both holes. The loop of the stake-pulling device is adjusted much the same way. A hole in the slider is aligned with one of the one or more holes in the sleeve tube. As the slider is pushed into the sleeve, the size of the loop outside the tube is decreased. A larger loop is generally used to pull out wooden stakes and a smaller loop is used for metal stakes.

The worker who is using the device, holds onto one end of the concrete pole and places the loop of the device over the stake that is in the freshly poured concrete. Once encircled the worker twists the pole causing the loop to tighten around the stake. The worker moves the pole that wiggles the stake back and forth. He does this until the stake becomes loose from its ground connection. The worker then lifts the stake out and over the freshly poured concrete to where it can be retrieved without walking in the fresh concrete.

The embodiment that is threaded is operated much the same as above. After the operation places the loop of the device over the stake, the worker twists the pole causing threaded slider tube to be threaded into the sleeve tube. This causes the loop to tighten onto the pole allowing it to be wiggled free of the concrete and lifted outside the perimeter of the slab.

CONCLUSIONS RAMIFICATIONS AND SCOPE

Thus the reader will see that the concrete stake pulling device of the invention, provides an useful and economical way for a worker to remove concrete stakes from the interior of the perimeter of a concrete slab, without disturbing the surface of the slab.

Thus the scope of the invention should be determined by the appended claims and their legal equivalents, rather than by the examples given. While the above description contains many specificities, these should not be construed limiting the scope of the invention but as merely providing illustrations of some of the presently preferred embodiments of this invention. For example, some of the illustrations of the invention show both ends of a line attached to a ferrule to form a loop. A loop could be created by a connection to the slider tube itself, or to the sleeve tube with out limiting the scope of this invention. The loop, while shown in the illustrations as being rope through tubing, could be a banded, flexible material without limiting the scope of the invention.

What is claimed is:

1. A stake-removal device for dislodging and removing stakes from a newly poured slab, comprising;

a stake holding means whereby a stake is securely held to be dislodged and removed from the interior of a perimeter of said slab, a concrete pole connection means whereby said stake removal device is connected to a concrete pole, said concrete pole connection means comprises a sleeve tube that fits over the diameter of the concrete poles;

wherein said sleeve tube is positioned and held in position on the pole by a spring button passing through aligned holes in the concrete pole and sleeve tube.

2. The stake-removal device of claim 1 wherein said stake holding means includes a flexible loop wherein said loop is positioned over the end of a concrete stake.

3. The stake-removal device of claim 2 wherein the loop is made from a flexible line.

4. The stake-removal device of claim 3 wherein the said line is covered with a flexible tube.

5. The stake-removal device of claim 2 wherein the flexible loop is created by the connection of two ends of an elongated flexible member by a ferrule crimped to hold said ends securely.

6. The stake-removal device of claim 5 wherein said ferrule is attached by a securing pin to a slider tube.

7. The stake-removal device of claim 6 wherein said slider tube is of sufficient size to fit within a sleeve tube.

8. The stake-removal device of claim 6 wherein the slider tube is held in position within the sleeve tube by a spring button passing through aligned holes located in the slider tube and the sleeve tube.

9. The stake-removal device of claim 2 wherein the loop is made from a band of flexible material.

10. The stake-removal device of claim 1 wherein said stake holding means is fixably attached to a slider tube, said slider tube including treads which correspond with threads in a sleeve tube, whereby the slider tube is threaded into said sleeve tube.

* * * * *